US006533625B1

(12) United States Patent
Taylor

(10) Patent No.: US 6,533,625 B1
(45) Date of Patent: Mar. 18, 2003

(54) WATER SKI

(76) Inventor: Paul E. Taylor, 24105 Morning Dove La., Murrietta, CA (US) 92562

( * ) Notice: Subject to any disclaimer, the term of this patent is extended or adjusted under 35 U.S.C. 154(b) by 0 days.

(21) Appl. No.: 10/005,741

(22) Filed: Dec. 3, 2001

(51) Int. Cl.[7] ..... A63C 15/00
(52) U.S. Cl. ..... 441/68; 441/79
(58) Field of Search ..... 441/68, 65, 74, 441/79; 280/607, 608, 609, 610

(56) References Cited

U.S. PATENT DOCUMENTS 3,099,025 A * 7/1963 Merkley et al. ..... 441/68
3,761,980 A * 10/1973 Silverstein ..... 441/68
3,774,254 A * 11/1973 Meyer ..... 441/68
3,827,096 A * 8/1974 Brownson ..... 441/68
4,608,023 A * 8/1986 Williams ..... 441/68
4,752,082 A * 6/1988 Sevington ..... 441/68
4,767,369 A * 8/1988 Snyder ..... 441/68
4,974,868 A * 12/1990 Morris ..... 441/74

* cited by examiner

*Primary Examiner*—S. Joseph Morano
*Assistant Examiner*—Lars A. Olson
(74) *Attorney, Agent, or Firm*—Charles C. Logan, II

(57) ABSTRACT

A water ski having an elongated body member having a fore-zone, a mid-zone, an aft-zone and a longitudinally extending X-axis. A major longitudinally extending groove is formed in the bottom surface of the water ski and it extends substantially the length of the mid-zone and the aft-zone. A plurality of longitudinally spaced left side minor grooves and right side minor grooves extend outwardly from the boundary edges of the major groove toward the respective left and right side edges of the water ski. Water traveling along the length of the major groove will also travel laterally outwardly through the respective left side and right side minor groove to give improved performance to the water ski.

17 Claims, 2 Drawing Sheets

WATER SKI

BACKGROUND OF THE INVENTION

The invention relates to water skis and more particularly to a water ski that planes up to the surface of the water more rapidly than traditional skis currently available in the market place.

Different water ski structures have been designed to improve the characteristics of the ride of the water skier. Some skis have been designed with a groove or channel extending longitudinally in their bottom surface. The Fortin U.S. Pat. No. 3,027,575 discloses a water ski made of composite material that may have either one or two concave running surfaces along the length of the water ski on its bottom surface. The Brownson U.S. Pat. No. 3,827,096 discloses a water ski also having a double channel formed in the bottom surface of the water ski with the channels being separated by a longitudinal convex ridge.

The Sharpe U.S. Pat. No. 3,950,807 discloses a one-piece molded plastic water ski having an elongated body of V-shaped transverse cross-section through the fore and mid sections of the ski, with the angle between the side walls increasing progressively toward the aft section to provide a substantially flat bottom of the aft end.

The Pitcairn U.S. Pat. No. 4,629,435 discloses a water ski having a pair of parallel concave longitudinal channels formed in the bottom surface of the water ski.

The Silverstein U.S. Pat. No. 3,761,980 discloses a water ski having a channel extending down the center of the bottom surface of the ski and having ridges formed on either side that have stepped surfaces.

It is an object of the invention to provide a novel water ski that will plane up the surface of the water more rapidly than traditional water skis sold today.

It is also an object of the invention to provide a novel water ski having structure on its bottom surface that will provide more acceleration for the water skier while making a turn than traditional skis due to increased pressure coming out of the side channels to function similar to a venturi.

It is another object of the invention to provide a novel water ski that provides more stability and better balance for the water skier.

SUMMARY OF THE INVENTION

The novel water ski has a fore-zone, a mid-zone and an aft-zone. The front tip end of the ski encompasses the fore-zone. A major concave groove having a concave transverse cross section extends substantially the length of the mid-zone and the aft zone. The major groove has a longitudinally extending X-axis. There are a plurality of left side minor grooves and right side minor grooves that extend outwardly toward the respective left side edge and right side edge of the water ski from the major groove. The minor grooves make an angle of approximately 4 degrees to 20 degrees with the longitudinally extending X-axis. The minor grooves also have a concave transverse cross section.

The advantages of the major groove and the minor grooves are quickly recognized by a water skier when he is being pulled by a watercraft. When pressure is applied to the bottom of the ski, the water is forced down the major groove toward the end of the ski causing the ski to plane up to the surface of the water more rapidly. Another advantage is that more acceleration is provided as the water is forced down the major and minor grooves toward the tail end of the ski.

The major groove can receive or accept a certain volume of water passing therethrough. The minor grooves can receive or accept a smaller volume of water due to their smaller cross section and this produces increased pressure since more water is being forced into a smaller volume as the water is forced into the minor grooves thereby creating increased pressure and acceleration. Forcing water evenly into the minor grooves on both sides of the major groove creates stability thereby causing less strain/effort to maintain the ski on a plane. The minor grooves produce a differential higher pressure proportional to the flow rate of the water passing through the major groove. The major and minor channels also provide more stability and balance for a skier due to the equal water pressure and flow out of the left and right minor grooves of the ski. The minor grooves force the water out causing more turning acceleration. An added benefit is that the speed of the boat accelerates without increasing the throttle of the engine because there is less drag on the skis and therefore less drag on the boat. The acceleration is therefore produced by using water pressure.

DESCRIPTION OF THE PREFERRED EMBODIMENT

Figure 1:
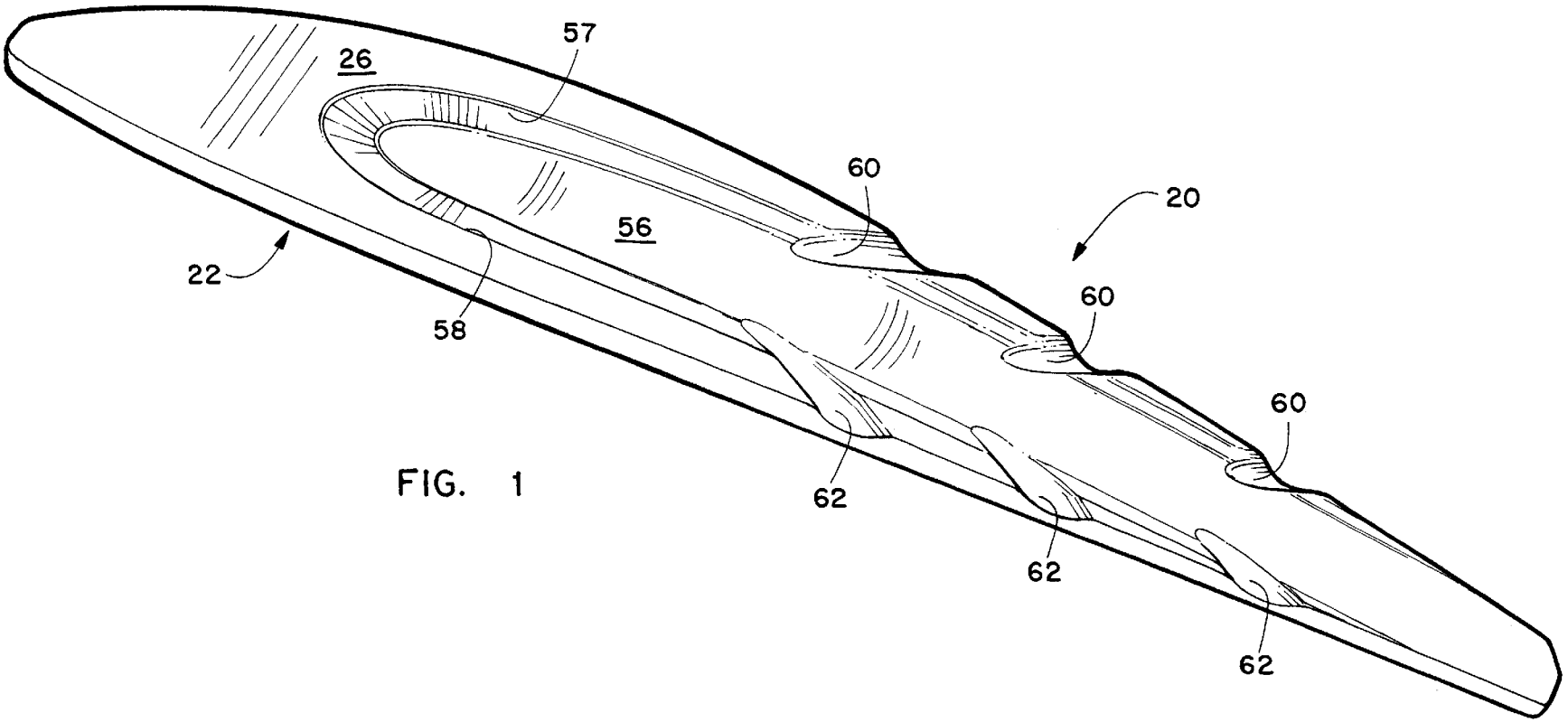
FIG. 1 is a bottom perspective view of the novel water ski.

The novel water ski will now be described by referring to FIGS. 1–9 of the drawings. The water ski is generally designated numeral 20.

The basic structure of water ski 20 will now be detailed by referring to FIGS. 1–4. Water ski 20 has an elongated body member 22 having a top surface 24, a bottom surface 26, a left side edge 27 a right side edge 28, a front tip end 30, a rear tail end 32, and a longitudinally extending X-axis. Elongated body member 22 has a length L1 in the range of 54–70 inches. Its greatest width is W1 and W1 is in the range of 5–12 inches. Body member 22 has a thickness T1 in the range of 0.5–1.5 inches. The length of elongated body member 22 is divided into a fore-zone 36, a mid-zone 38 and an aft-zone 40. Fore-zone 36 would be approximately 12 inches long. A fin 42 would be attached to the bottom surface of aft-zone 40.

Figures 2, 3, 4, 5, 6, 7:
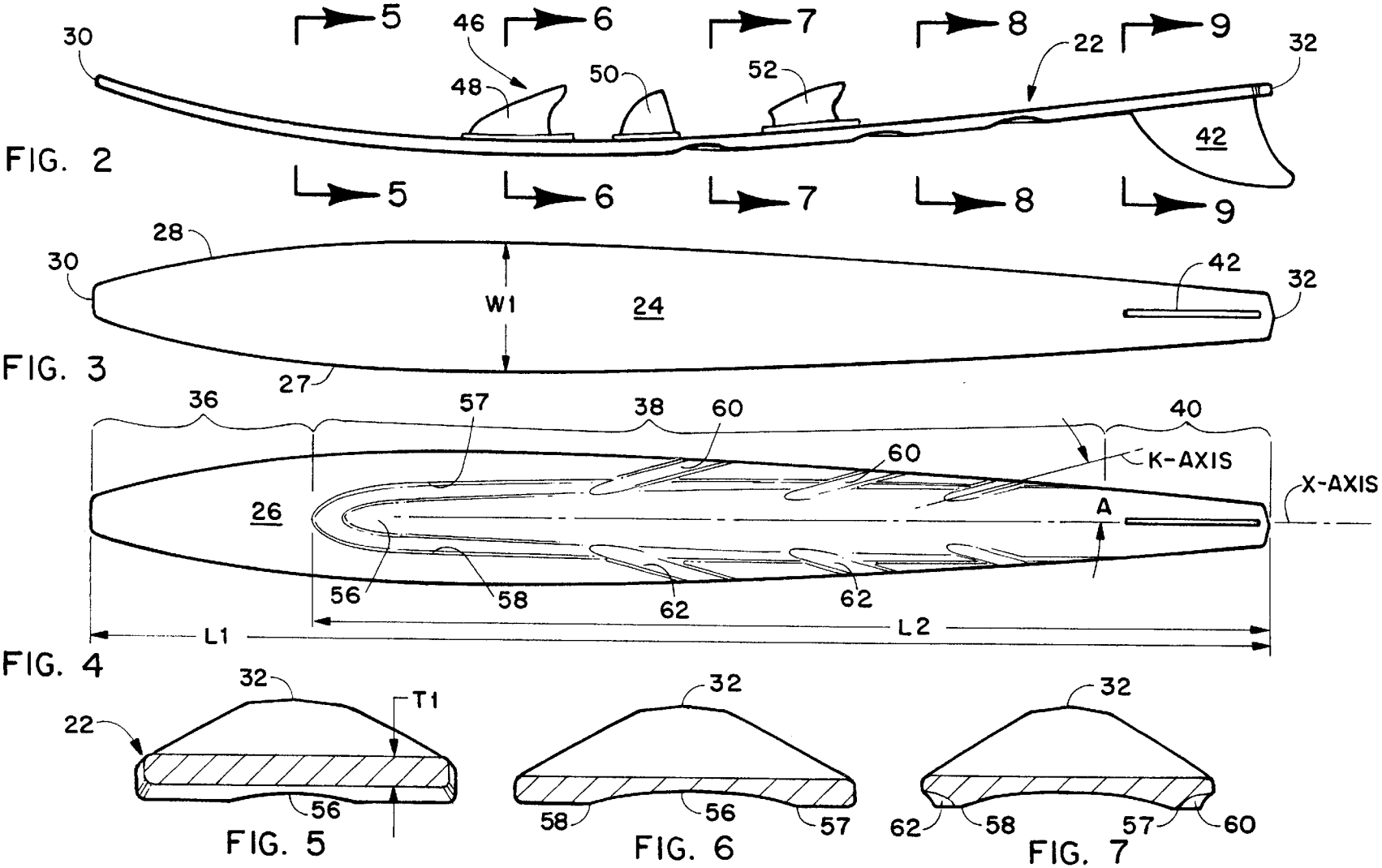
FIG. 2 is a left side elevation view of the novel water ski.
FIG. 3 is a top plan view of the novel water ski with the foot bindings removed.
FIG. 4 is a bottom plan view of the novel water ski.
FIG. 5 is a cross sectional view taken along lines 5—5 of FIG. 2 with the foot bindings removed for clarity.
FIG. 6 is a cross sectional view taken along lines 6—6 of FIG. 2 with the foot bindings removed for clarity.
FIG. 7 is a cross sectional view taken along lines 7—7 of FIG. 2 with the foot binding removed for clarity.

Foot binding 46 is only shown in FIG. 2. Foot binding 46 has a toe piece 48 and a heel piece 50. The illustrated embodiment of water ski 20 is a slalom ski and it has a toe piece 52 mounted rearwardly of foot binding 46.

A major groove 56 is formed in the bottom surface 26 and it extends for most of the combined length of mid-zone 38 and aft-zone 40. Major groove 56 has a left boundary edge 57, a right boundary edge 58 and a length L2. A plurality of left side minor grooves 60 and a plurality of right side minor grooves 62 each have a K-axis that makes an angle A with the longitudinally extending X-axis of elongated body member 22. Angle A would be in the range of 4–20 degrees. The front end of the left side minor grooves 60 are in communication with major groove 56. The rear end of the left side minor grooves 60 extend to the left side edge 27. The front end of the right side minor grooves 62 is in communication with major groove 56. The rear ends of the right side minor grooves 62 extend to the left side edge 27.

FIG. 5 is a cross sectional view taken along lines 5—5 of FIG. 2. It shows the rear tail end 32, a cross section of elongated body member 22 and the early portion of major groove 56.

FIG. 6 is a cross sectional view taken along lines 6—6 that shows that the width of major groove 56 has increased and it has a right boundary edge 58 and a left side boundary edge 57.

FIG. 7 shows that the width of major groove 56 has increased further and the rear ends of left side minor groove 60 and right side minor groove 62 are also seen.

Figure 9:
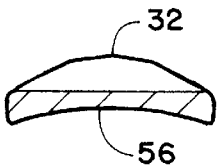
FIG. 9 is a cross sectional view taken along lines 9—9 of FIG. 2 with the fin removed for clarity.
Figure 8:
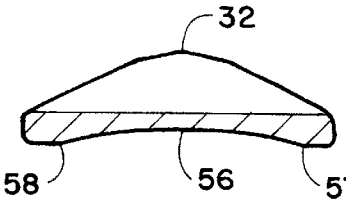
FIG. 8 is a cross sectional view taken along lines 8—8 of FIG. 2.

FIGS. 8 and 9 show the width of body member 22 decreasing and also that the width of major groove 56 is also decreasing.

The elongated body 22 would be preferably made of plastic composite material or wood. Other materials that also have desirable characteristics may be used.

The foregoing is considered as illustrative only of the principles of the invention. Further, since numerous modifications and changes will readily occur to those skilled in the art, it is not desired to limit the invention to the exact construction and operations shown and described, and accordingly all suitable modifications and equivalents may be resorted to, falling within the scope of the invention as claimed.

What is claimed is:

1. A water ski comprising:

an elongated body member having a top surface, a bottom surface, a front tip end, a rear tail end, a left side edge, a right side edge, a longitudinally extending X-axis, a length L1, a width W1 at its widest point and a thickness T1;

at least one major longitudinally extending groove formed in said bottom surface and said major groove extends a length L2 and L2 is less than L1; said at least one major groove having a left boundary edge and a right boundary edge;

at least one left side minor groove in said bottom surface of said elongated body member extending laterally from said left boundary edge of said major groove toward said left side edge of said elongated body member;

at least one right side minor groove in said bottom surface of said elongated body member extending laterally from said right boundary edge of said major groove toward said right side edge of said elongated body member; and each of said right side minor grooves and said left side minor grooves have a longitudinally extending K-axis and said K-axes are oriented at an acute angle A with respect to said X-axis of said elongated body member.

2. A water ski as recited in claim 1 wherein said elongated body member has at least three left side minor grooves and three right side minor grooves and they are spaced longitudinally along said bottom surface of said elongated body member.

3. A water ski as recited in claim 1 wherein angle A is substantially in the range of 4–20 degrees.

4. A water ski as recited in claim 1 wherein said left side minor grooves and said right side minor grooves extend respectively all of the way to said left side edge and said right side edge of said elongated body member.

5. A water ski as recited in claim 1 wherein L2 is at least equal to 0.5 L1.

6. A water ski as recited in claim 1 wherein L1 is in the range of 54 inches-70 inches.

7. A water ski as recited in claim 1 wherein W1 is in the range of 5 inches-12 inches.

8. A water ski as recited in claim 1 wherein T1 is in the range of 0.5–1.5 inches.

9. A water ski as recited in claim 1 wherein said elongated body member is made of wood material.

10. A water ski as recited in claim 1 wherein said elongated body member is made of composite material.

11. A water ski as recited in claim 1 wherein said elongated body member has a fin extending downwardly from said bottom surface; said fin being positioned adjacent said rear tail end.

12. A water ski as recited in claim 11 further comprising means on said top surface of said elongated body member for removably receiving a water skiers foot.

13. A water ski as recited in claim 1 wherein said major groove has a concave contoured transverse cross-section.

14. A water ski as recited in claim 1 wherein said elongated body member has a fore-zone, a mid-zone and an aft-zone and said major groove extends substantially the length of said mid-zone and said aft-zone.

15. A water ski as recited in claim 14 wherein said minor grooves are located in said mid-zone.

16. A water ski as recited in claim 1 wherein said elongated body member has at least two left side minor grooves and two right side minor grooves and they are spaced longitudinally along said bottom surface of said elongated body member.

17. A water ski comprising:

an elongated body member having a top surface, a bottom surface, a front tip end, a rear tail end, a left side edge, a right side edge, a longitudinally extending X-axis, a length L1, a width W1 at its widest point and a thickness T1;

at least one major longitudinally extending groove formed in said bottom surface and said major groove extends a length L2 and L2 is less than L1; said at least one major groove having a left boundary edge on said bottom surface and a right boundary edge on said bottom surface, and an upwardly extending upper surface extending between said left boundary edge and said right boundary edge;

at least one left side minor groove having a front end and a rear end formed in said bottom surface of said elongated body member; said at least one left side minor groove extending laterally from said left boundary edge of said major groove toward said left side edge of said elongated body member; said front end of said at least one left side minor groove intercepts said upper surface of said major groove at a location above said left boundary edge of said major groove so that a portion of water flowing along said major groove is directed laterally outwardly along said at least one left side minor groove; and at least one right side minor groove having a front end and a rear end formed in said bottom surface of said elongated body member; said at least one right side minor groove extending laterally from said right boundary edge of said major groove toward said right side edge of said elongated body member; said front end of said at least one right side minor groove intercepts said upper surface of said major groove at a location above said right boundary edge of said major groove so that a portion of water flowing along said major groove is directed laterally outwardly along said at least one right side minor groove.

* * * * *